US005722465A

United States Patent [19]

Herrlein

[11] Patent Number: 5,722,465

[45] Date of Patent: Mar. 3, 1998

[54] MECHANISM FOR ADJUSTING THE TERRY PILE HEIGHT

[75] Inventor: Wilhelm Herrlein, Ravensburg, Germany

[73] Assignee: Lindauer Dornier Gesellschaft mbH, Lindau, Germany

[21] Appl. No.: 723,531

[22] Filed: Sep. 30, 1996

[30] Foreign Application Priority Data

Oct. 6, 1995 [DE] Germany ..... 195 37 277.8

[51] Int. Cl.[6] ..... D03D 39/22

[52] U.S. Cl. ..... 139/25; 139/26

[58] Field of Search ..... 139/25, 26

[56] References Cited

U.S. PATENT DOCUMENTS

| | | | |
|---|---|---|---|
| 3,428,095 | 2/1969 | Pfarrwaller | 139/25 |
| 3,724,509 | 4/1973 | Burgess et al. | 139/25 |
| 5,392,817 | 2/1995 | Seifert et al. | 139/25 |
| 5,423,354 | 6/1995 | Herrlein . | |
| 5,518,037 | 5/1996 | Takahashi et al. | 139/25 |

FOREIGN PATENT DOCUMENTS

| | | | |
|---|---|---|---|
| 0257857 | 3/1988 | European Pat. Off. . | |
| 0298454 | 1/1989 | European Pat. Off. . | |
| 0350446 | 1/1990 | European Pat. Off. . | |
| 0518809 | 12/1992 | European Pat. Off. . | |
| 0 534 403 | 3/1993 | European Pat. Off. | 139/25 |
| 4432452 | 3/1995 | Germany . | |
| 7145534 | 6/1995 | Japan . | |

*Primary Examiner*—Andy Falik
*Attorney, Agent, or Firm*—W. G. Fasse; W. F. Fasse

[57] ABSTRACT

A terry cloth weaving loom operating with a fabric displacement drive that controls the terry formation fabric motion, is equipped with a terry pile height adjusting mechanism operatively integrated in the fabric displacement drive between a crank arm (26) of a fabric feed roller (9) and a double lever (29) driven by the main loom drive. The terry pile height adjusting mechanism adjusts the terry pile height in response to a control signal for a servo-motor that drives the adjusting mechanism only for the adjustment but not for any transmission of substantial fabric displacement forces.

12 Claims, 2 Drawing Sheets

MECHANISM FOR ADJUSTING THE TERRY PILE HEIGHT

FIELD OF THE INVENTION

The invention relates to a terry cloth weaving loom that operates on the basis an oscillating displacement of the beat-up edge of a fabric being produced. The oscillating displacement of the fabric takes place in the rhythm and synchronously with the drive of the weaving reed.

BACKGROUND INFORMATION

Various methods and devices are known for producing of terry cloth on looms. For example, the pile formation can be accomplished with a so-called sley control according to European Patent Publication EP 0.298.454 B1 (Takahashi et al.), published Jan. 11, 1989. The loom disclosed in this publication is capable to produce terry cloth with a pile height that is variable during the weaving operation. For this purpose the sley shaft of the loom is connected to a controllable servo-drive through respective gear components. The servo-drive is independent of the main loom drive. Such a servo-drive is freely controllable even individually for each weft insertion. Such a control of the separate servo-drive makes it possible to achieve any desired terry cloth formation rhythm and such rhythm can be changed in any desired sequence. However, the present invention is not concerned with a sley control for the purpose of controlling the pile height in terry cloth.

A terry cloth weaving loom has been manufactured as a prototype for producing terry cloth with a variable pile height by way of a so-called fabric control. The fabric control is separate and independent of the main loom drive for the free control of the fabric movement for each individual weft insertion. A separate fabric displacement drive is connected to and cooperates with transmission elements for varying the pile height during the weaving operation. These transmission elements which are effective on the pile formation components of the loom, control the motion or displacement of the fabric and of the main warp. The separate, controllable fabric displacement drive in this prototype was a hydraulic linear amplifier with an integral proportional closed loop control. The prototype was capable, by means of an electronic control, to work a program for the pile height and to also realize smooth fabric borders without piles.

European Patent Publication EP 0.350.446 B1 (Spiller et al.) published on Jan. 10, 1990 discloses a method and weaving loom for producing terry cloth with pile formation components including mechanisms for varying the floor height in accordance with the principle of a sley control described above. However, Spiller et al. also disclose realizing a variable pile height in a terry cloth by applying the principle of the fabric displacement control. Spiller et al. operate at least one separate drive for a pile formation mechanism that is capable of varying the pile height because its separate drive is freely controllable for each weft insertion. A servo-motor is used for the separate drive of the pile formation mechanism which is coupled to the servo-motor through a reduction gear and/or transmission elements connected to at least one pile formation member.

German Patent Publication DE 4.432.452 A1 (Takahashi et al.), published Mar. 23, 1995, discloses a terry cloth weaving loom with a terry formation mechanism for the continuous variation of the pile height during the weaving. The formation of the terry pile also is operating on the basis of the so-called fabric control, namely the weft beat-up edge of the fabric is displaced in the rhythm and synchronously with the weft beat-up motion of the reed toward the beat-up position of the reed and again away from that position. The terry cloth formation mechanism comprises a ball spindle device connected to a motor drive that is controllable for the reversal of the rotational direction of the ball spindle in accordance with a pattern. One arm of an angle lever mounted for rotation is pivoted to the ball spindle mechanism. The other arm of the angle lever is coupled with a so-called intermediate lever which is also rotatably mounted. The intermediate lever includes a pivot for a coupling member coming from the angle lever and pivots for two additional lever arms, one of which is connected to a second coupling member which in turn is connected to a loom component, causing the fabric displacement motion, while the other lever arm of the intermediate lever is pivoted through a further lever arm with a third coupler or connecting rod that in turn is operatively connected to a loom component which influences the pile warp tension.

In all loom types described above, for the production of terry cloth, the formation of a variable pile height rests on the use of a separate servo-motor which is controllable independently of the main loom drive. The controllable servo-motor is either connected with loom components for displacing the fabric relative to the beat-up line or with loom components for the adjustment of the beat-up position of the reed. Such a servo-motor requires a high drive power for performing the terry cloth formation motion.

OBJECTS OF THE INVENTION

In view of the above it is the aim of the invention to achieve the following objects singly or in combination:

- to derive the power for the adjustment of the terry cloth pile height from the main loom drive through an eccentric gear transmission which is connected with loom components for the fabric displacement relative to the beat-up line for the purpose of forming a predetermined pile height;
- to provide a pile height adjustment mechanism for terry cloth weaving looms in which the terry formation is performed on the basis of the fabric displacement or fabric motion control;
- to provide a pile height adjustment that is continuously variable starting from a fixed first pile height; and
- to drive the loom components for the terry cloth motion from the main loom drive while adjusting the pile height adjustment mechanism with a relatively small servo-motor requiring a small power input.

SUMMARY OF THE INVENTION

According to the invention the following features are combined in a terry cloth weaving loom including a pile height adjusting mechanism driven by a separately controllable drive for the pile height adjusting mechanism. The loom is equipped with at least one eccentric drive that receives its drive power from the main loom drive for performing a basic terry cloth formation motion, whereby the eccentric cam drive operates at least one spring bias double lever mounted on a rotation or journal shaft rigidly secured in a loom frame. A fabric displacing component for displacing a beat-up line of the fabric relative to a reed beat-up position is operatively connected to the spring biased double lever. The terry pile height adjusting mechanism is arranged between the double lever and the fabric displacement component. Coupling elements operatively connect the terry pile height adjusting mechanism to the double lever and to the fabric displacement component for displacing the terry cloth fabric.

By integrating the pile height adjusting mechanism into the mechanism that transmits the terry cloth formation motion of the fabric, the adjustment drive for the pile height adjustment mechanism can be small because the power for performing the terry cloth formation motion is derived from the main loom drive and only the adjustment movement is driven separately.

The present pile height adjustment mechanism takes advantage of known components for performing the so-called basic terry cloth formation motion and influences these components in such a way that a variation of the pile height can be accomplished within a given range starting from a basic pile height.

BRIEF DESCRIPTION OF THE DRAWINGS

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION

Figure 1:
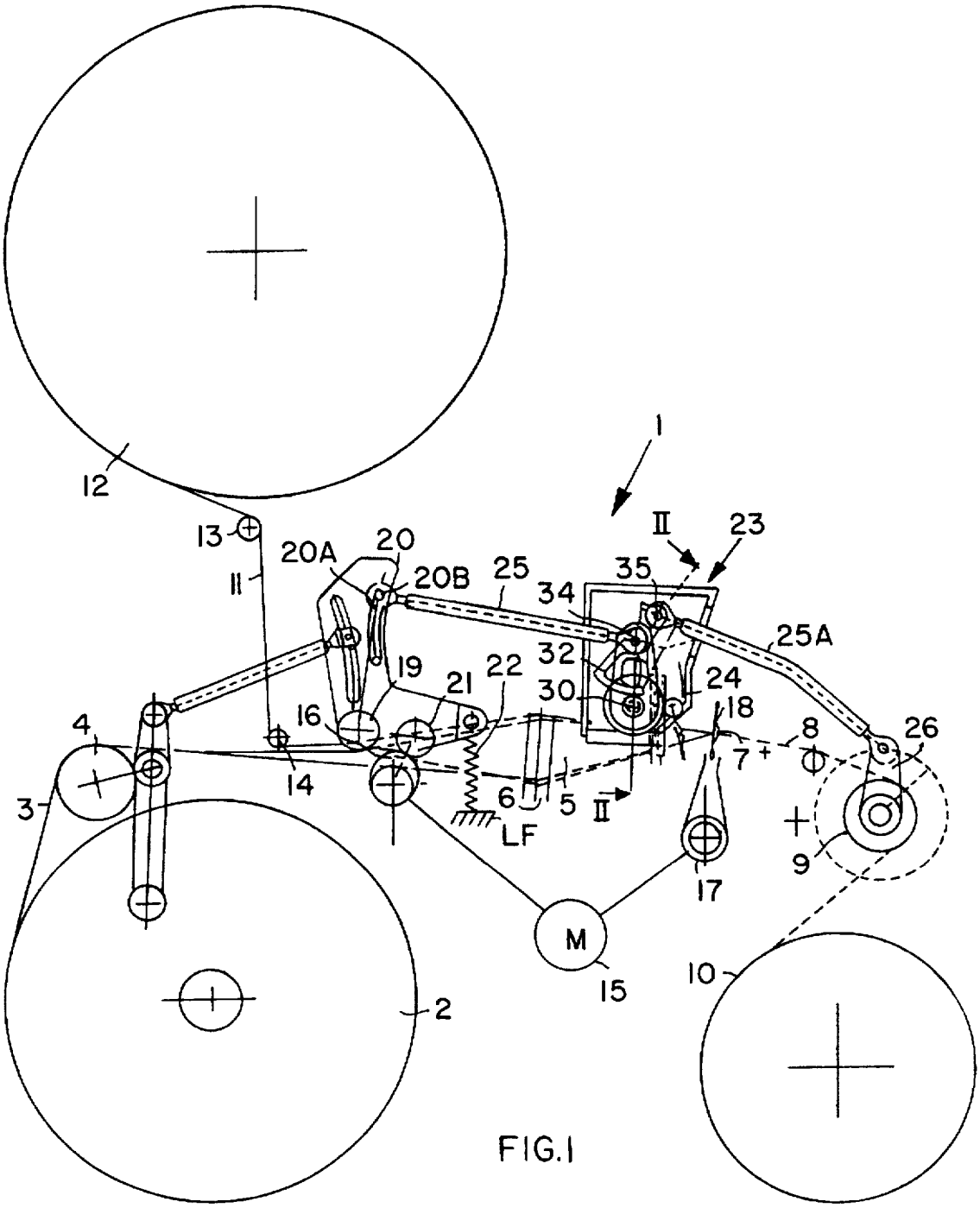
FIG. 1 shows a schematic side view of a terry cloth weaving loom according to the invention equipped with a pile height adjustment mechanism integrated into the power transmission for the terry cloth formation fabric displacement drive components, particularly between a double lever of these components and the fabric displacement drive.

FIG. 1 shows a weaving loom 1 including a main warp beam 2 carrying the ground or main warp threads 3 running from the main warp beam 2 over a warp tension beam 4 to the loom shed formation components 6 that form the loom shed 5 and on to the beat-up line 7 along an edge of the finished fabric 8 which is guided over a fabric displacement loom component 9 such as the fabric take-up roller 9 that transports the finished fabric onto the fabric take-up roller or beam 10. Additional guide rollers may be arranged upstream and downstream of the fabric take-up roller 9. The pile warp thread 11 travels from the pile warp beam 12 over a guide roller 13 to a floating tensioning roller 14 and on to the shed formation component 6 and to the beat-up line 7 of the fabric 8.

A main loom drive is schematically illustrated by its motor 15 that drives at least one so-called terry cloth eccentric drive 16 on the one hand, and the sley 17 to which the reed 18 is secured. The terry cloth eccentric drive 16 cooperates, or rather drives a double lever 20 that is journalled to a journal shaft 19 secured to the loom frame not shown. The shaft 19 is rotatably supported in the loom frame LF and one lever arm carrying a cam follower roller 21 is biased by a tension spring 22, the other end of which is secured to the loom frame LF. The biasing spring 22 makes sure that the cam follower roller 21 remains constantly in contact with the eccentric drive cam 16 driven by the main loom drive motor 15. According to the invention a pile height adjustment mechanism 23 is arranged between the double lever 20 and the fabric take-up roller 9. The pile height adjustment mechanism 23 has its own controllable drive motor 24 that is independent of and requires substantially less power than the main loom drive motor 15.

At least one coupling rod 25, 25A is journalled or pivoted at one rod end to an arm 26 of the fabric take-up roller 9. The other rod end is journalled or pivoted to the double lever 20. This coupling transmits the basic terry cloth formation motion from the lever 20 driven by the main loom drive 15 through the cam 16 to the fabric take-up roller 9. By integrating the pile height adjustment mechanism 23 between the double lever 20 and the fabric take-up roller 9 the adjustment mechanism functions as a coupling link for the transmission of the basic terry cloth formation motion from the eccentric cam 16 through the double lever 20 to the fabric take-up roller 9. A coupling rod for this purpose is divided into two sections 25, 25A. One rod section 25 is pivoted to the pile height adjustment mechanism 23 and to the double lever 20. The other rod section 25A is pivoted to the pile height adjustment mechanism 23 and to the arm 26 of the fabric take-up roller 9. The two pivot or journal points at the adjustment mechanism 23 are located at different levels. The pivot point 20B between the coupling rod section 25 and the double lever 20 is position adjustable along a longitudinal guide hole 20A in the double lever 20. The position of pivot point 20B along the guide hole 20A determines the basic terry cloth formation motion. This position adjustable pivot point 20B is movable for adjustment, but locked again after adjustment. By shifting the pivot point 20B within the guide hole 20A, it is possible to determine most varied terry cloth formation motions.

Figure 2:
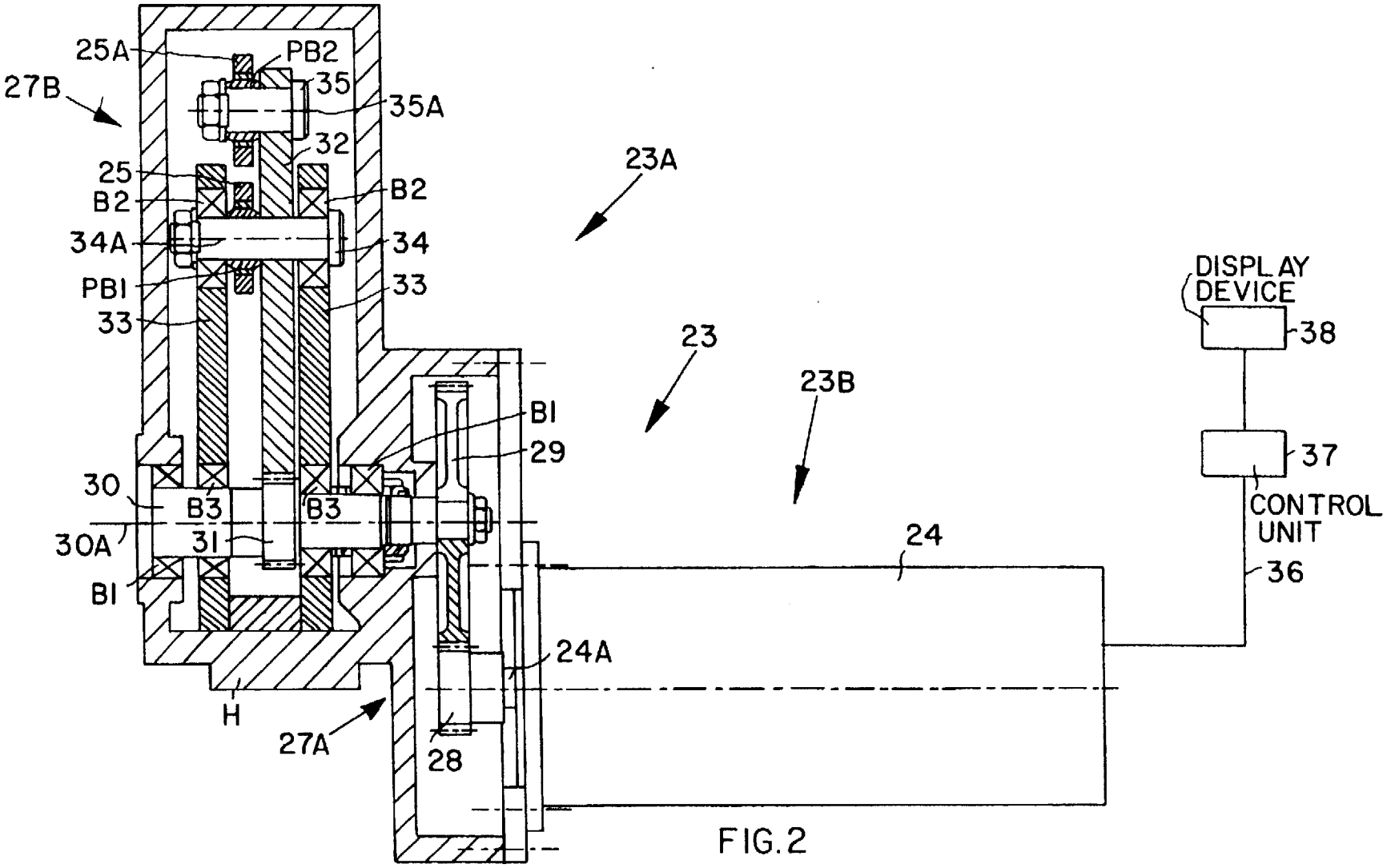
FIG. 2 shows a sectional view along section line II—II in FIG. 1, illustrating the gear drive transmission of the pile height adjustment mechanism with its own drive independent of the main loom drive.

FIG. 2 shows the pile height adjustment mechanism 23 according to the invention, comprising two sections namely a gear transmission 23A and a drive 23B including a controllable servo-motor 24 having a drive shaft 24A. The gear transmission section 23A comprises a first gear subassembly 27A and a second gear subassembly 27B. The first gear subassembly 27A comprises a drive pinion 28 rigidly secured to the drive shaft 24A for rotation with the drive shaft 24A. A drive shaft 30 provided in common for both gear subassemblies 27A and 27B is rotatably mounted in a housing H on bearings B1. A driven gear wheel 29 that meshes with the drive pinion 28, is rigidly mounted on the shaft 30 for rotation therewith.

The second gear subassembly 27B comprises a drive pinion 31 rigidly mounted on the shaft 30 for rotation with the shaft 30 about the longitudinal, rotational shaft axis 30A. The subassembly 27B further comprises a toothed gear sector 32 meshing with the pinion 31. The gear sector 32 is mounted for tilting by one, preferably two, bearing plates 33 connected to the sector 32 through bearings B2 through which a first bolt 34 passes to permit rotation or tilting of the sector 32 about a tilting axis 34A. The preferred two bearing plates 33 are identical to each other and in turn are mounted rotatably through bearings B3 on the common shaft 30. The two bearing plates 33 are spaced from each other so that the gear sector 32 is arranged between the two bearing plates 33 leaving sufficient space for the coupling rod section 25 also connected to the bolt 34 by a pivot bearing PB1. The gear sector 32 carries, spaced from the first bolt 34 a second bolt 35 that connects the coupling rod section 25A to the upper end of the gear sector 32 through a pivot bearing PB2.

The drive motor 24 is connected through a control signal conductor 36 to a control unit 37 for the adjustment of the pile height. A display device 38 is also connected to the control unit 37 for selecting, for example through a keyboard the intended pile height. Instead of using an electro-servo motor 24, it is possible, for example to use a pneumatic or hydraulic drive for the purpose of operating the pile height adjustment mechanism 23 according to the invention.

In operation, the angular extent of the tilting of the gear segment 32 as adjusted by the motor 24 in response to a pile height adjustment signal on the conductor 36 will determine the pile height. More specifically, initially a first or base pile height is determined by positioning the pivot point 20B of the coupling rod section 25 along the guide hole 20A in the double lever 20. The eccentric cam 16 drives the lever 20, whereby the rotation of the cam 16 is converted into an oscillating motion of the double lever 20 about the journal shaft 19 with the help of the spring 22. This oscillating motion is transmitted through the pile height adjustment mechanism 23 to the fabric take-up roller 9. For this purpose the gear sector 32 of the mechanism 23 is coupled to the double lever 20 by the coupling rod section 25 and to the fabric take-up roller 9 by the coupling rod section 25A, whereby the roller 9 and thus the fabric 8 and the position of the beat-up line 7 oscillate back and forth. The amplitude of this back and forth oscillation determines the pile height. The oscillation amplitude in turn is determined by the angular position of the pivot points PB1 and PB2 relative to each other and by their respective spacings from the rotational axis 30A of the bearing plate 33 that mounts the gear sector 32 in the housing H. When the rotational position of the gear sector 32 is changed by the control motor 24 driving the gear sector 32 through the pinion gears 28, 29 and 31 for varying the pile height, the above mentioned relative angular position of the pivot points PB1 and PB2 is changed. This change in turn changes the effective length of the coupling rod 25A and thus the pile height.

Although the invention has been described with reference to specific example embodiments, it will be appreciated that it is intended to cover all modifications and equivalents within the scope of the appended claims.

What is claimed is:

1. A terry cloth weaving loom comprising a terry pile height adjusting mechanism (23), a separately controllable drive (24) for said adjusting mechanism, a terry cloth formation drive including an eccentric cam drive drivable by a main loom drive for performing a basic terry cloth formation motion, at least one spring biased double lever mounted on a rotation journal shaft rigidly secured in a loom frame and operable by said eccentric cam drive, a fabric displacement component (9) for displacing a beat-up line of the fabric relative to a reed beat-up position, and further comprising coupling members (25, 25A) operatively connecting said terry pile height adjusting mechanism (23) to said double lever (20) and to said fabric displacement component (9), whereby said terry pile height adjusting mechanism (23) is arranged between said double lever (20) and said fabric displacement component (9) for transmitting said basic terry cloth formation motion from said eccentric cam drive (16) to said fabric displacement component (9), and wherein said terry pile height adjusting mechanism comprises an adjustable drive (23) including a driven section (23A) and a drive section (23B), said driven section including a first gear subassembly (27A) operatively connected to said drive section (23B) and a second gear subassembly (27B) for transmitting an adjustment drive force, a housing (H) for said first and second gear subassemblies, a common shaft (30) mounted for rotation in said housing and interconnecting said first and second gear subassemblies (27A, 27B) in said housing, at least one bearing plate (33) mounted on said common shaft (30) for tilting about said common shaft (30), a gear sector (32) tiltably mounted to said bearing plate (33) for tilting in response to said adjustment drive force applied to said gear sector (32) through said first and second gear subassemblies, and pivot elements (34, 35; PB1, PB2) pivoting said coupling members to said gear sector (32).

2. The terry cloth weaving loom of claim 1, wherein said pivot elements comprise a first pivot (34, PB1) pivotally mounting said gear sector (32) to said at least one bearing plate (33) and pivotally securing one coupling member (25) of said coupling members (25, 25A) to said gear sector (32), and a second pivot (35, PB2) pivotally mounting the other coupling member (25A) to said gear sector (32).

3. The terry cloth weaving loom of claim 2, wherein said first pivot (34, PB1) and said second pivot (35, PB2) have respective first and second pivot axes (34A, 35A) that are radially spaced from a rotational axis (30A) of said common shaft (30) at different radial spacings.

4. The terry cloth weaving loom of claim 3, wherein said first pivot axis (34A) of said first pivot (34, PB1) is radially spaced from said rotational axis (30A) at a first spacing, wherein said second pivot axis (35A) of said second pivot (35, PB2) is radially spaced from said rotational axis (30A) at a second spacing that is longer than said first spacing, whereby said second pivot (35, PB2) is positioned radially outwardly of said first pivot (34, PB1) relative to said rotational axis (30A).

5. The terry cloth weaving loom of claim 1, wherein said drive section (23B) comprises a servo-motor (24) connected to a control unit (37) for controlling said servo-motor (24) in accordance with a terry cloth weaving pattern stored as a program in a memory of said control unit.

6. The terry cloth weaving loom of claim 1, wherein said first and second gear subassemblies comprise reduction gears (28, 29; 31, 32).

7. A pile height adjusting mechanism for a loom, said adjustment mechanism (23) comprising a gear section (23A) and a drive section (23B) including a separately controllable drive (24) operatively connected to said gear section (23A), a housing (H) for said gear section (23A), a common drive shaft (30) rotatably mounted in said housing (H), said gear section (23A) comprising a first gear subassembly (27A) and a second gear subassembly (27B) mounted on said common drive shaft (30) having a rotational axis (30A) in said housing (H), said first gear subassembly (27A) comprising a first gear (28) connected to said drive (24) and a second gear (29) meshing with said first gear (28), said second gear being rigidly mounted on said common drive shaft, said second gear subassembly comprising a third gear (31) rigidly mounted on said common drive shaft (30) for rotation therewith and a fourth gear forming a gear sector (32) meshing with said third gear (31), said gear section further comprising at least one bearing plate (33) journalled to said common drive shaft (30), a first journal bolt (34) pivotally mounting said gear sector (32) to said bearing plate (33) constructed as a lever mounted for tilting about said rotational axis (30A) of said common drive shaft (30), and wherein said gear sector (32) has an end opposite its gear teeth, said opposite end comprising a second journal bolt (35), said first journal bolt (34) and said second journal bolt (35) being adapted for a pivotal connection to a first coupling member (25) and to a second coupling member (25A) for connection between a fabric displacement component (9) and to a double lever (20) driven by a main loom drive (15, 16).

8. The pile height adjusting mechanism of claim 7, further comprising a first pivot (PB1) on said first journal bolt (34) for one of said coupling members, and a second pivot (PB2) on said second journal bolt (35) for the other of said coupling members.

9. The pile height adjusting mechanism of claim 7, wherein said drive section (23B) comprises a servo-motor (24) connected to a control unit (37) for controlling said servo-motor (24) in accordance with a terry cloth weaving pattern stored as a program in a memory of said control unit.

10. The pile height adjusting mechanism of claim 7, wherein said first and second gear subassemblies comprises reduction gears (28, 29; 31, 32).

11. The terry cloth weaving loom of claim 8, wherein said first pivot (34, PB1) and said second pivot (35, PB2) have respective first and second pivot axes (34A, 35A) that are radially spaced from a rotational axis (30A) of said common shaft (30) at different radial spacings.

12. The terry cloth weaving loom of claim 11, wherein said first pivot axis (34A) of said first pivot (34, PB1) is radially spaced from said rotational axis (30A) at a first spacing, wherein said second pivot axis (35A) of said second pivot (35, PB2) is radially spaced from said rotational axis (30A) at a second spacing that is longer than said first spacing, whereby said second pivot (35, PB2) is positioned radially outwardly of said first pivot (34, PB1) relative to said rotational axis (30A).

* * * * *